US008421330B2

(12) United States Patent
Haba et al.

(10) Patent No.: US 8,421,330 B2
(45) Date of Patent: Apr. 16, 2013

(54) CARBON FILM HAVING SHAPE SUITABLE FOR FIELD EMISSION

(75) Inventors: Masanori Haba, Osaka (JP); Nan Jiang, Osaka (JP); Hong-Xing Wang, Osaka (JP); Akio Hiraki, Osaka (JP)

(73) Assignee: Pureron Japan Co., Ltd, Fukushima (JP)

( * ) Notice: Subject to any disclaimer, the term of this patent is extended or adjusted under 35 U.S.C. 154(b) by 224 days.

(21) Appl. No.: 12/912,303

(22) Filed: Oct. 26, 2010

(65) Prior Publication Data

US 2011/0037375 A1 Feb. 17, 2011

Related U.S. Application Data

(62) Division of application No. 11/500,988, filed on Aug. 9, 2006, now Pat. No. 7,839,067.

(30) Foreign Application Priority Data

| | | |
|---|---|---|
| Aug. 10, 2005 | (JP) | P2005-232017 |
| Aug. 25, 2005 | (JP) | P2005-244409 |
| Sep. 5, 2005 | (JP) | P2005-256829 |
| Jan. 6, 2006 | (JP) | P2006-001231 |

(51) Int. Cl.
*H01J 1/30* (2006.01)

(52) U.S. Cl.
USPC ..... 313/336; 313/351

(58) Field of Classification Search ..... None
See application file for complete search history.

(56) References Cited

U.S. PATENT DOCUMENTS

| | | | | |
|---|---|---|---|---|
| 6,741,019 | B1 | 5/2004 | Filas et al. | |
| RE38,561 | E | 8/2004 | Keesmann et al. | |
| 6,812,480 | B2 * | 11/2004 | Lee et al. | 257/10 |
| 6,917,156 | B2 | 7/2005 | Moore | |
| 7,138,759 | B2 | 11/2006 | Kyogaku | |
| 2002/0125805 | A1 | 9/2002 | Hsu | |
| 2005/0041752 | A1 | 2/2005 | Rosen | |
| 2005/0236963 | A1 * | 10/2005 | Kang et al. | 313/495 |
| 2006/0119248 | A1 | 6/2006 | Howard et al. | |
| 2006/0290259 | A1 | 12/2006 | Song et al. | |

FOREIGN PATENT DOCUMENTS

| | | | |
|---|---|---|---|
| JP | 6-242439 | A | 9/1994 |
| JP | 10-223128 | A | 8/1998 |
| JP | 2004-362919 | A | 12/2004 |
| JP | 2005-332735 | A | 12/2005 |

OTHER PUBLICATIONS

Korean Office Action, w/ English translation thereof, issued in Korean Patent Application No. KR 10-2006-0075193 dated Sep. 26, 2012.

* cited by examiner

*Primary Examiner* — Ashok Patel
(74) *Attorney, Agent, or Firm* — McDermott Will & Emery LLP

(57) ABSTRACT

A carbon film of the present invention has an elongated needle shape whose radius decreases toward a tip. The shape is, preferably, a shape in which a field concentration coefficient β in the Fowler-Nordheim equation is expressed by h/r where r denotes the radius in an arbitrary position and h denotes height from the arbitrary position to the tip.

11 Claims, 22 Drawing Sheets

CARBON FILM HAVING SHAPE SUITABLE FOR FIELD EMISSION

RELATED APPLICATIONS

This application is a Divisional of U.S. patent application Ser. No. 11/500,988, filed on Aug. 9, 2006 now U.S. Pat. No. 7,839,067, claiming priority of Japanese Patent Application Nos. JP 2005-232017, filed on Aug. 10, 2005, JP 2005-244409, filed on Aug. 25, 2005, JP 2005-256829, filed on Sep. 5, 2005, and JP 2006-001231, filed on Jan. 6, 2006, the disclosures of which Applications are incorporated by reference herein.

BACKGROUND OF THE INVENTION

1. Field of the Invention

The present invention relates to a carbon film having a shape suitable for performing field emission.

2. Description of the Related Art

It is known that field emission can be expressed by the Fowler-Nordheim equation describing density of current emitted to vacuum. The equation is given by the following.

$$I=sAF^2/\phi\exp(-B^{3/2}/F)$$

$$F=\beta V$$

where I denotes field emission current, s denotes field emission area, A denotes constant, F denotes field strength, $\phi$ is work function, B is constant, $\beta$ is field concentration coefficient, and V is application voltage.

The field concentration coefficient $\beta$ is a coefficient for converting the application voltage V to the field strength F(V/cm) in accordance with the shape of the tip portion and the geometric shape of a device.

The smaller the work function $\phi$ of a material is and the larger the field concentration coefficient $\beta$ is, the stronger the field emission current I becomes, and the field emission current I increases.

Electrons are confined in a solid body by a potential barrier expressed as the work function $\phi$. When the electric field is strongly concentrated on the surface of the solid body and the potential barrier becomes thinner to about 1 nm or less, the probability that electrons are emitted from the solid body to vacuum by the tunneling phenomenon due to the wave nature of electrons sharply increases.

The phenomenon that electrons are emitted to vacuum due to the field concentration is called field emission. The field emission current I can be obtained by integrating the product between the incidence density of electrons which collide with the potential barrier and the probability that the electrons tunnel the potential barrier with an overall energy region.

The Fowler-Nordheim equation shows the above. As a structure of performing such field emission, for example, a Spindt-type field emission structure in which a small conical shape is formed by silicon or metal is known.

However, in the Spindt type, the height of the tip is limited so that it is difficult for the Spindt type to address an improvement in the field emission characteristic.

To solve the drawback of the Spindt type, a carbon nanotube having a high aspect ratio is being developed. The carbon nanotube is obtained by forming a carbon film in a needle shape by performing the chemical vapor deposition (CVD) or the like. The carbon nanotube is extremely narrow and long, the radius "r" of curvature of the tip is smaller than that of the Spindt type, the field concentration coefficient $\beta$ increases, and the field emission characteristic becomes excellent.

In the case of a carbon nanotube, however, at the time of increasing the application voltage to increase the field emission current I, after the voltage exceeds an application voltage, the field emission current I does not increase and is saturated.

Consequently, in the case of using a carbon nanotube as an electron emission source for various devices, apparatuses, and the like, for example, in the case of using a carbon nanotube for a field-emission-type illuminating lamp, at the time of adjusting the right emission brightness by adjusting application voltage, the adjustment range is extremely regulated.

In a carbon nanotube, the aspect ratio as a ratio of height to diameter is extremely high, so that the heights of tips tend to vary and are not easily aligned. Further, since the tips are not easily aligned and it is hard to mechanical support the carbon nanotube on a substrate, stability is missing. It is difficult for a carbon nanotube to come into electric contact with a substrate for passing current. When a number of carbon nanotubes are provided at high density, field concentration is suppressed and the electron emission characteristic easily deteriorates.

SUMMARY OF THE INVENTION

A main object of the present invention is to provide a carbon film in which saturation of a field emission current occurring in association with an increase in application voltage is suppressed.

To achieve the object, a carbon film according to the invention has an elongated needle shape whose radius decreases from an arbitrary position toward a tip.

Preferably, the shape is a shape in which a field concentration coefficient $\beta$ in the Fowler-Nordheim equation is expressed by h/r where r denotes the radius in an arbitrary position and h denotes height from the arbitrary portion to the tip.

In the above, the shape of the carbon film according to the invention includes the case where the radius decreases as a whole toward the tip even if a portion where the radius is partly large exists between an arbitrary position to the tip.

The shape of the carbon film according to the invention is not limited to the shape in which the portion between an arbitrary position to the tip is straight but may be a shape in which the portion is curved, bent, or the like. In the shape of the carbon film according to the invention, it is sufficient that the radius decreases as a whole toward the tip.

The arbitrary position is not limited to a base portion of a carbon film but may be some midpoint.

In the carbon film according to the invention, when application voltage increases and the field emission is saturated at the tip portion, fields are emitted from another portion. As a result, with increase in the application voltage, the field emission increases, and saturation of the field emission is suppressed.

In the carbon film according to the invention, in the case where the shape is a shape in which a field concentration coefficient $\beta$ is expressed by h/r where r denotes the radius in an arbitrary position and h denotes height from the arbitrary portion to the tip, first, when the application voltage is low, in the tip portion having the smallest radius, the field concentration coefficient $\beta$ becomes the maximum on the basis of the expression and the field emission is performed. Second, when the field emission in the tip portion is saturated, while maintaining the field emission at the tip portion, the field emission is performed on the basis of the expression in a portion in which the radius gradually increases.

Preferably, the shape is a shape simulated to a cone, and the center angle θ of the apex of the cone satisfies the relation of 0<θ<20. A profile of an outer peripheral surface forming the pseudo cone is not limited to be linear. In the profile, the radius may be increased or decreased in some midpoint. It is sufficient that the center angle θ lies in the range as a whole.

Examples of the profile of the outer peripheral surface of the pseudo cone include a quadric-like curve, an exponential curve, and a shape in which various curves exist. The profile can be simulated to a cone whose radius decreases to the tip as a whole.

In the case where the tip of a needle-shaped carbon film has the radius r0 of curvature, the apex of the pseudo cone is not limited to the tip of the needle-shape carbon film but may be on an extension line of the outer peripheral surface of the pseudo cone.

BRIEF DESCRIPTION OF THE DRAWINGS

Other objects of the present invention will be apparent from the understanding of the embodiments described below as are defined in the appended claims. A variety of other benefits than those not mentioned in this specification will also be understood by those who skilled in the art by performing the present invention.

DETAILED DESCRIPTION OF THE INVENTION

In a carbon film according to a preferred embodiment of the present invention, a field concentration coefficient β in the Fowler-Nordheim equation is expressed by h/r where r denotes the radius in an arbitrary position and h denotes height from the arbitrary position to the tip. The carbon film is a needle-shaped carbon film having a shape in which its radius decreases from an arbitrary position to the tip. The needle-shaped carbon film has an aspect ratio of 100 to tens thousands, a diameter of 2 to 200 nm, and a length of tens to tens thousands nm.

The needle-shaped carbon film will be described with reference to FIGS. 1A and 1B and FIGS. 2A to 2C.

Figure 1A:
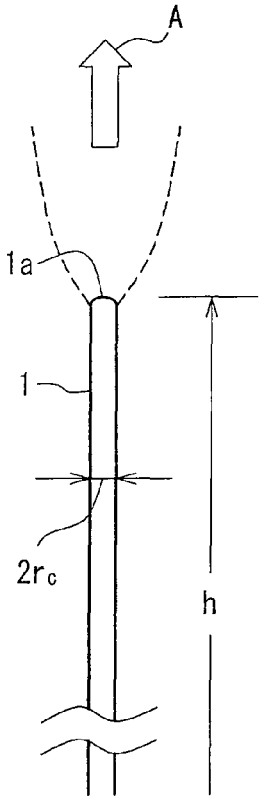
FIG. 1A is a schematic diagram of a carbon nanotube as an example of a conventional carbon film.
Figure 1B:
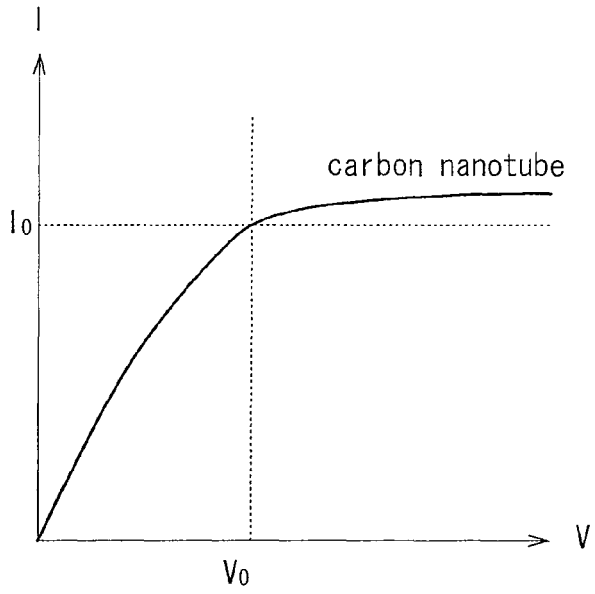
FIG. 1B is a diagram showing a characteristic of a field emission current for applied voltage in the carbon nanotube of FIG. 1A.
Figure 2A:
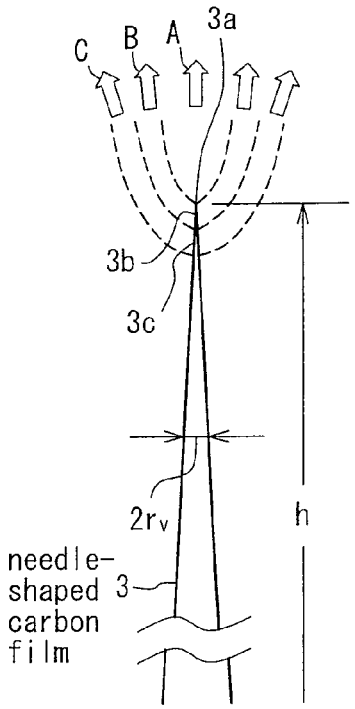
FIG. 2A is a schematic diagram of a needle-shaped carbon film in a first preferred embodiment of the invention.
Figure 2B:
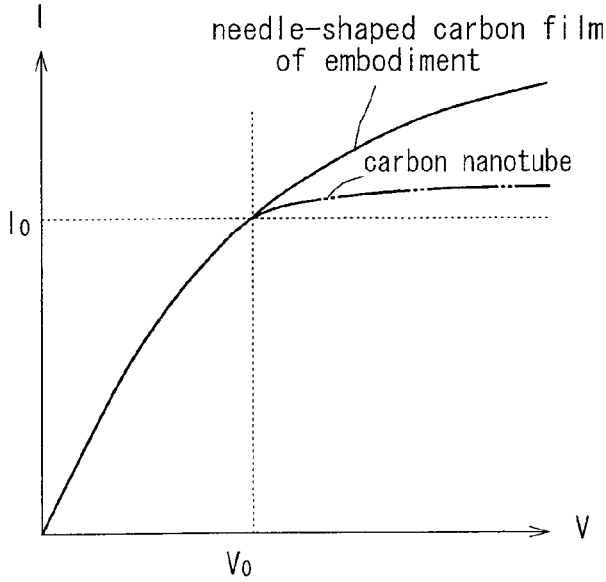
FIG. 2B is a diagram showing characteristics of field emission current in the case where voltage is applied to the carbon nanotube and the case where voltage is applied to the needle-shaped carbon film.

FIG. 1A shows a tip portion 1*a* of a conventional carbon nanotube 1 and its periphery, and FIG. 1B shows characteristics of a field emission current I by application voltage V in the carbon nanotube. FIG. 2A shows a tip portion 3*a* of a needle-shaped carbon film 3 of the embodiment and its periphery. FIG. 2B shows characteristics of the field emission current I by the application voltage V in the needle-shaped carbon film 3.

In the diagrams, the shape, diameter, and the like are exaggerated for easier understanding. The not-shown base portion of each of the carbon nanotube 1 and the needle-shaped carbon film 3 is in the arbitrary position, and the height of the tip from the base portion is set as "h".

As shown in FIG. 1A, although the carbon nanotube 1 has a curved surface having a radius r0 of curvature in its tip portion 1*a*, when the carbon nanotube 1 is viewed generally from the tip portion 1*a* to the not-shown downward base portion, the carbon nanotube 1 has a tube shape having an almost constant radius rc. As described above, the carbon nanotube 1 has a tube shape having a radius rc which is almost constant from the tip portion 1*a* to the base portion. Consequently, the carbon nanotube 1 does not have a shape to which the definition of the field concentration coefficient β expressed by the equation (β=h/r) of the needle-shaped carbon film 3 except for the tip portion 1*a* can be applied. In the carbon nanotube 1, when the application voltage V in FIG. 1B increases, the field emission current I from the tip portion 1*a* increases, and the field is emitted as shown by the arrow A in FIG. 1A.

In the carbon nanotube 1, when the application voltage exceeds V0, as shown by the solid curve of FIG. 1B, the field emission from the tip portion 1*a* is saturated and increase of the field emission current I after $I_0$ is suppressed.

Since the conventional Spindt type does not have an elongated needle-shape but has a pyramid shape (in a Spindt type of conical silicon, the center angle is 70.5 degrees), the definition of the field concentration coefficient β cannot be applied.

Since the needle-shaped carbon film 3 has a shape whose radius rv decreases toward the tip portion 3*a* as shown in FIG. 2A, the field is emitted as shown by the arrow A in FIG. 2A from the tip portion 3*a* as the application voltage V increases as shown in FIG. 2B. Further, when the application voltage V increases, the field emission occurs as shown by the arrow B in FIG. 2A also from a portion 3*b* apart from the tip portion 3*a*. When the application voltage V further increases, field emission occurs as shown by the arrow C in FIG. 2A also from a portion 3*c* which is further from the tip portion 3*a*. The solid curve of FIG. 2B shows the field emission characteristic of the needle-shaped carbon film 3, and the alternate long and two short dashes line indicates the field emission characteristic of the carbon nanotube 1.

Figure 2C:
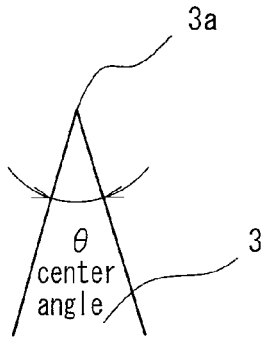
FIG. 2C is a diagram showing the tip portion of the needle-shaped carbon film.

In the needle-shaped carbon film 3, even if the application voltage V exceeds V0, the field emission current I0 increases without being saturated. Preferably, as shown in FIG. 2C (though it is exaggerated), the needle-shaped carbon film 3 falsely has a conical shape and the center angle θ (degrees) of the apex of the pseudo cone as the tip portion 3*a* satisfies the relation of $0<\theta<20$.

As described above, by the control of the application voltage V, the needle-shaped carbon film 3 having the narrow angle θ and including the tip portion 3*a* and the portion 3*b* near the tip portion 3*a* as a whole acts as one field concentration portion. As a result, saturation of the field emission current I is suppressed. Consequently, by the needle-shaped carbon film 3, light emission brightness in a field emission type illuminating lamp can be easily controlled to arbitrary brightness.

Figure 3:
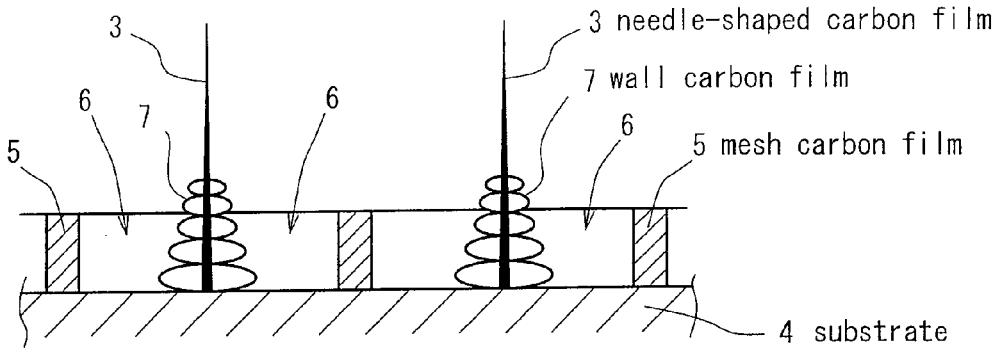
FIG. 3 is a diagram showing a carbon film structure including the needle-shaped carbon film.
Figure 4:
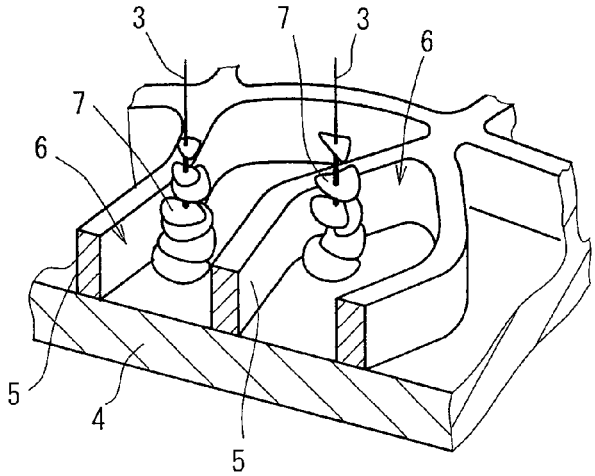
FIG. 4 is a perspective view of the carbon film structure including the needle-shaped carbon film.
Figure 5:
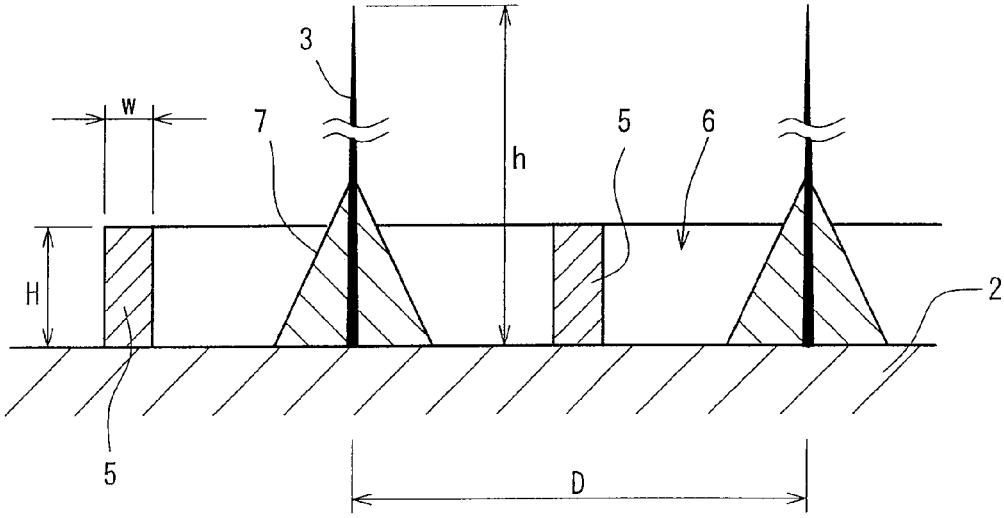
FIG. 5 is a schematic diagram showing the carbon film structure including the needle-shaped carbon film.

With reference to FIGS. 3 to 5, application development of the needle-shaped carbon film 3 will be described. FIG. 3 is a partial cross section of a carbon film including the needle-shaped carbon film 3. FIG. 4 is a partial perspective view of the carbon film. FIG. 5 is a side view schematically showing the carbon film. In those diagrams, an electron emission source including the carbon film and a substrate is shown.

In those diagrams, a mesh carbon film 5 continuous in a curved shape is formed on the substrate 4 by a film forming technique, for example, DC plasma CVD. The material of the substrate 4 is, preferably, a silicon wafer, quartz glass, or the like. A metal film or a conductive film may be provided on the surface of the substrate 4. The substrate 4 may be made of a metal such as aluminum. The substrate 4 may be a substrate having any of various shapes of rectangle, circle and the like or a wire-shaped substrate. The carbon film may be variously used as a reinforcing member utilizing the strength of the carbon film, an electric material used for an electric wire or the like utilizing conductivity of the carbon film, an electron material for use in an electron emitter or the like, utilizing the electron emission characteristic of the carbon film. Preferably, impurities are not mixed in the electron emitter. It is important that diameter, length, and performance of the electronic emitter are controllable.

When viewed from above, the mesh carbon film 5 continuously formed on the substrate 4 generally has a mesh shape.

The height, h of the mesh carbon film 5 is about 10 nm or less, and the width (W) of the mesh carbon film 5 is about 4 nm to 8 nm.

Regions 6 on the substrate 4 surrounded by the mesh carbon film 5 are regions in each of which the needle-shaped carbon film 3 is formed as an electron emission point extending in a needle shape and having a tip on which electric fields are concentrated and which emits electrons.

The region 6 is surrounded by the mesh carbon film 5 so that the intervals between the electron emission points formed in the regions 6 can be restricted or specified.

In the regions 6, the needle-shaped carbon films 3 whose tips serve as electron emission points are formed by the film forming technique, for example, the DC plasma CVD.

The needle-shaped carbon film 3 is formed with the height (h) higher than the height (H) of the mesh carbon film 5, for example, about 60 μm. In the needle-shaped carbon film 3, the field concentration coefficient β in the Fowler-Nordheim equation is expressed by h/r where r denotes the radius in a base portion which is in an arbitrary position and h denotes height from the base portion to the tip. The radius of the needle-shaped carbon film 3 decreases from an arbitrary position toward the tip. The needle-shaped carbon film 3 can be formed by uniformly applying the electric field perpendicular to or almost perpendicular to a rectangular substrate disposed on one of parallel plate electrodes which are in parallel with each other and face each other. The needle-shaped carbon film 3 is formed by uniformly applying the electric field to the whole peripheral surface of a conductive wire disposed in the center of a cylindrical shape along the longitudinal direction of the coil and having a circular shape in section. Consequently, the needle-shaped carbon film 3 can be disposed almost perpendicular to the substrate face of the rectangular substrate and disposed in the radius direction on the outer peripheral surface of the conductive wire.

On the needle-shaped carbon film 3, a wall-shaped carbon film 7 is formed so as to extend from the lower part of the needle-shaped carbon film 3 to some intermediate point of the needle-shaped carbon film 3 by the film depositing technique, for example, the DC plasma CVD.

The wall-shaped carbon film 7 supports the needle-shaped carbon film 3 on the substrate 4 and can be in electric contact with the substrate 4.

The shape viewed from the side of the wall-shaped carbon film 7 is a shape which spreads toward the bottom. The shape is, for example, a petal shape.

As will be described with an SEM photograph which will be described later, the shape is not a geometrically perfect petal shape but is described as a shape easy to understand. As shown in an SEM photograph, in reality, the wall-shaped carbon film 7 has various shapes such as a laterally spread shape or a spiral shape.

In any case, the wall-shaped carbon film 7 is in contact with the substrate 4 with a wide bottom area, thereby enabling the needle-shaped carbon film 3 to be mechanically strongly supported by the substrate 4 and enabling the electric contact of the needle-shaped carbon film 3 to the substrate 4 to be sufficiently assured.

In the above-described carbon film structure shown in FIGS. 3 to 5, the needle-shaped carbon film 3 has a high aspect ratio like a carbon nanotube. However, since the wall-shaped carbon film 7 is formed so as to spread like a wall around the needle-shaped carbon film 3 from a lower part to some midpoint of the needle-shaped carbon film 3, the needle-shaped carbon film 3 is mechanically strongly supported on the substrate 4 and does not easily fall on the substrate. As a result, in the carbon film structure, even if the diameter of the needle-shaped carbon film 3 is small, the electric contact with the substrate for passing current can be made by the wall-shaped carbon film 7. As a result, the carbon film structure can obtain the electron emission characteristic necessary as an electron emission source of an illuminating lamp.

Figure 6:
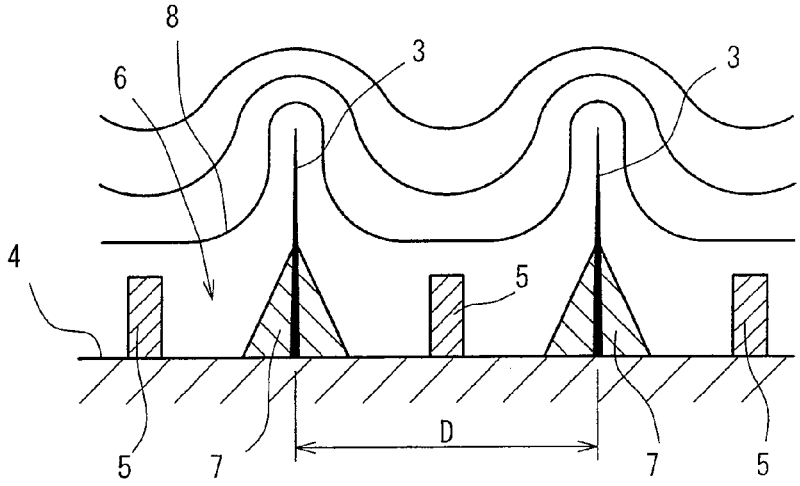
FIG. 6 is a diagram showing a state of field concentration on the carbon film structure including the needle-shaped carbon film.

In the carbon film structure, as shown in FIG. 6, by application of a voltage across the anode and the cathode facing each other in parallel on the substrate, a potential surface 8 around the tip of the needle-shaped carbon film 3 sharply changes, and the electric field is concentrated strongly.

In the mesh carbon film 5, the electric field concentration does not occur. The needle-shaped carbon films 3 are formed at proper intervals D, for example, about 100 μm by the mesh carbon film 5 so as not to disturb the electric field concentration action between the needle-shaped carbon films 3. One or more needle-shaped carbon films 3 can be formed in one mesh region 6.

In the above carbon film structure shown in FIGS. 3 to 5, the needle-shaped carbon film 3 has an aspect ratio as the ratio of height to diameter almost equal to that of a carbon nanotube. The wall-shaped carbon film 7 suppresses fluctuations of the tips and mechanically supports the needle-shaped carbon film 3 on the substrate, so that high stability is obtained and an electric contact with the substrate can be assured. Unlike the carbon nanotube, density is limited, field concentration easily occurs, and the electron emission characteristic is excellent.

Figure 7:
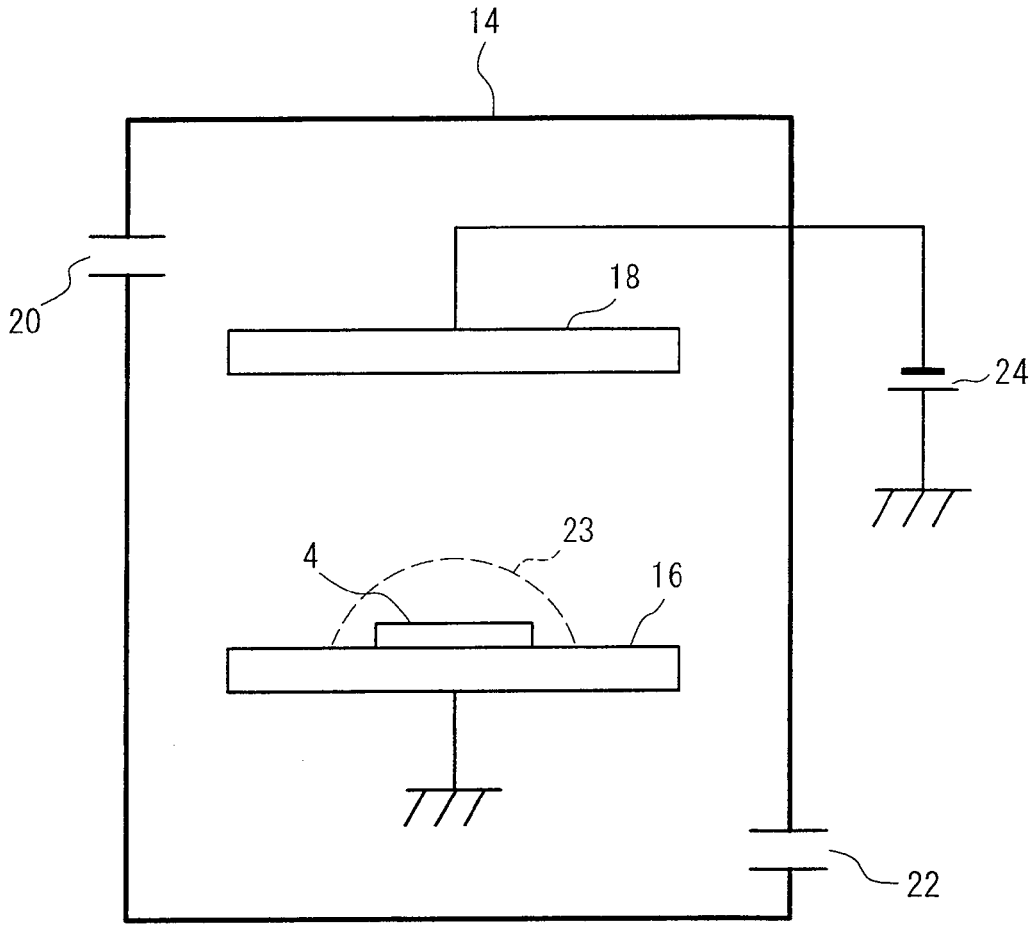
FIG. 7 is a schematic configuration diagram of a film depositing apparatus.
Figure 8:
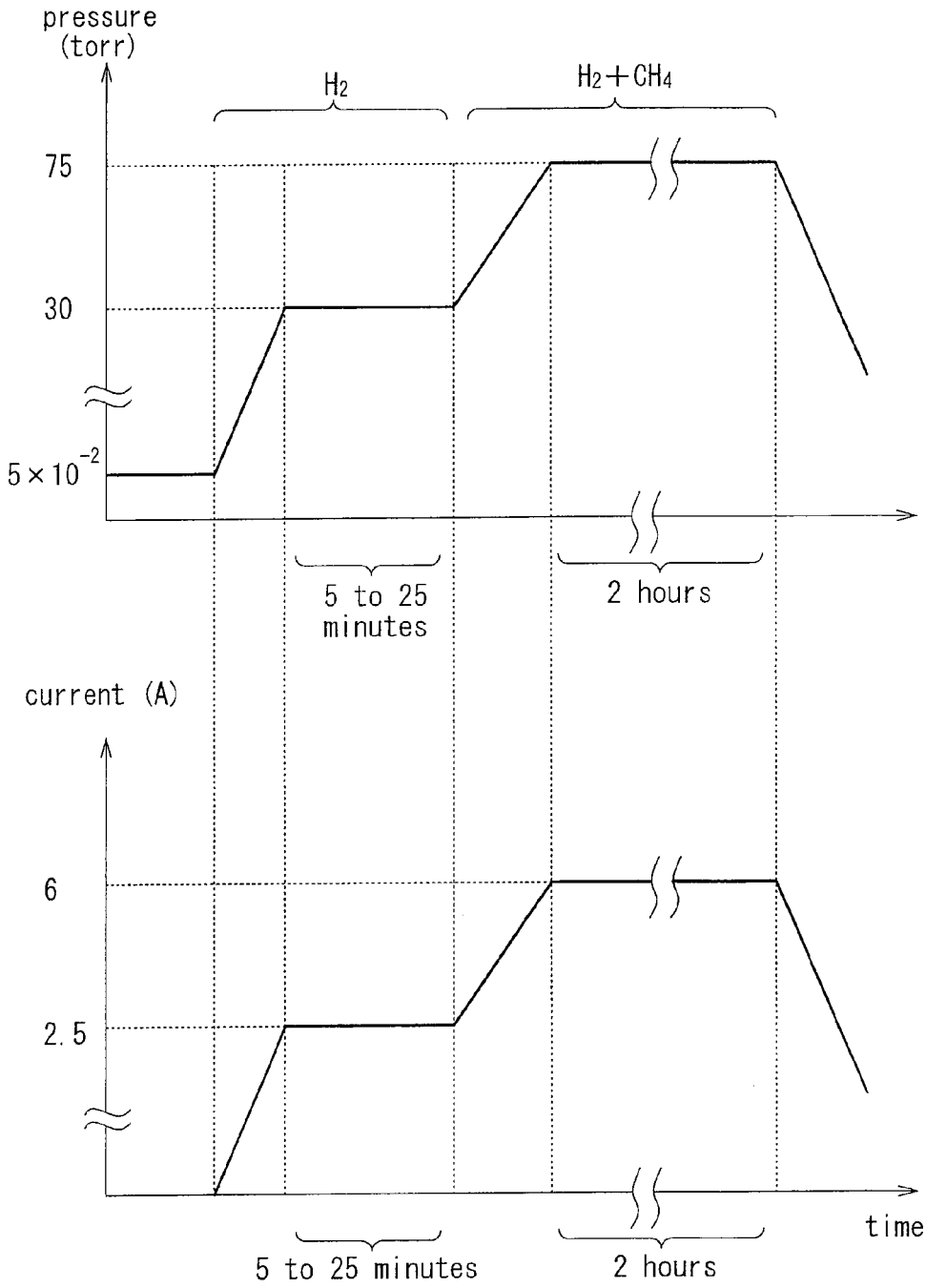
FIG. 8 is a diagram showing a film depositing operation.

A carbon film forming method will be described with reference to FIGS. 7 and 8. FIG. 7 is a diagram showing a schematic configuration of a film depositing apparatus used for film formation. FIG. 8 is a diagram showing pressure in a chamber used for film depositing operation and current.

In a chamber 14 made of quartz, a pair of parallel plane electrodes 16 and 18 is disposed so as to face each other. The chamber 14 has a gas introduction pipe 20 and a gas exhaust port 22. The negative electrode side of a DC power source 24 is connected to the upper parallel plane electrode 18, and the positive electrode side of the DC power source 24 is grounded.

The lower parallel plane electrode 16 is grounded. Gas introduced into the chamber 14 is mixture gas of hydrogen and methane. On the lower parallel plane electrode 16, the substrate 4 is mounted.

Hydrogen gas is introduced from the gas introduction port 20 into the chamber 14 to gradually decrease the internal pressure to about 30 torr, and the pressure in the chamber 14 is set to 30 torr. When the pressure in the chamber 14 becomes 30 torr, the pressure is maintained for about 5 to 25 minutes.

In this case, by application of current from the DC power source 24, plasma 23 is generated to gradually increase the current to about 2.5 A. When the pressure in the chamber 14 becomes 30 torr, the current is maintained at 2.5 A. In such a manner, an oxide on the substrate 4 is removed.

Next, the mixture gas of hydrogen gas and methane gas is introduced from the gas introduction port 20 into the chamber 14 to gradually increase the pressure in the chamber 14 to about 75 torr. When the pressure in the chamber 14 becomes 75 torr, the internal pressure is maintained for about two hours.

The pressure is not limited to the above. The embodiment can be carried out with the pressure of 10 to 100 torr. In this case, simultaneously, current is gradually increased by the DC power source 24 to about 2.5 A to 6 A. When the current reaches 6 A, the current is maintained for two hours.

In place of the methane gas, another gas containing carbon, for example, gas such as acetylene, ethylene, propane, or propylene or vapor of an organic solvent such as carbon monoxide, carbon dioxide, ethanol, or acetone can be used.

As a result, by the plasma 23 generated onto the substrate 4, the temperature of the substrate 4 becomes about 900° C. to 1,150° C., the methane gas is decomposed, and the carbon film shown in FIGS. 1 and 2 is formed on the surface of the substrate 4.

Figure 9:
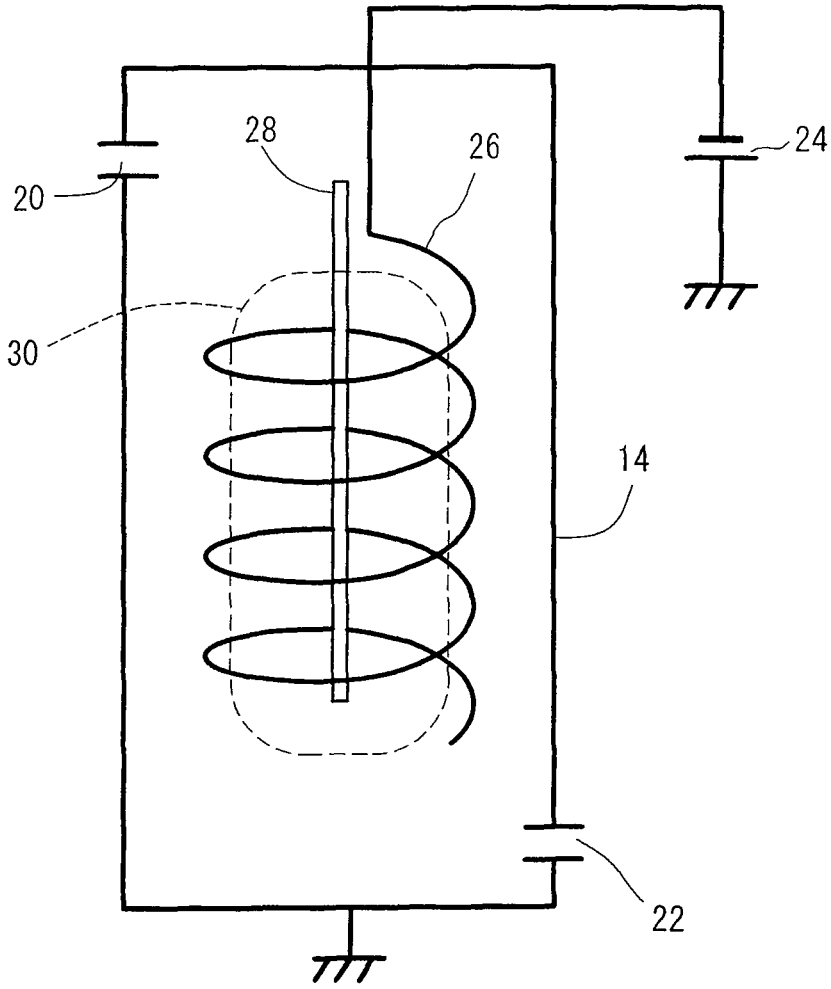
FIG. 9 is a schematic configuration diagram of another film depositing apparatus.

The embodiment can be carried out also with a film depositing apparatus shown in FIG. 9 in place of the above-described film depositing apparatus. The film depositing apparatus shown in FIG. 9 has the conductive or insulating cylindrical chamber 14, and the chamber 14 is provided with the gas introduction port 20 and the gas exhaust port 22. In the chamber 14, a coil 26 as a cylindrical substrate is disposed.

A conductive wire 28 is disposed along almost the center axis in the coil 26. The coil 26 extends straight in one direction and a plasma 30 is generated cylindrically in the internal space. The wire 28 extends in an elongated shape in the internal space. The inner peripheral surface of the coil 26 and the outer peripheral surface of the wire 28 face each other with almost uniform distance in the extension direction. One end of the coil 26 is connected to the negative electrode side of the DC power source 24.

Also in the film depositing apparatus, in a manner similar to the above, the pressure in the chamber 14 and the current are controlled in accordance with operations shown in FIG. 8. By the control, the carbon film shown in FIG. 3 on the surface of the wire 28 can be formed.

With reference to SEM (scanning electron microscope) photographs of FIGS. 10 to 16, the carbon film formed on the substrate by the film depositing apparatus will be described.

Figure 10:
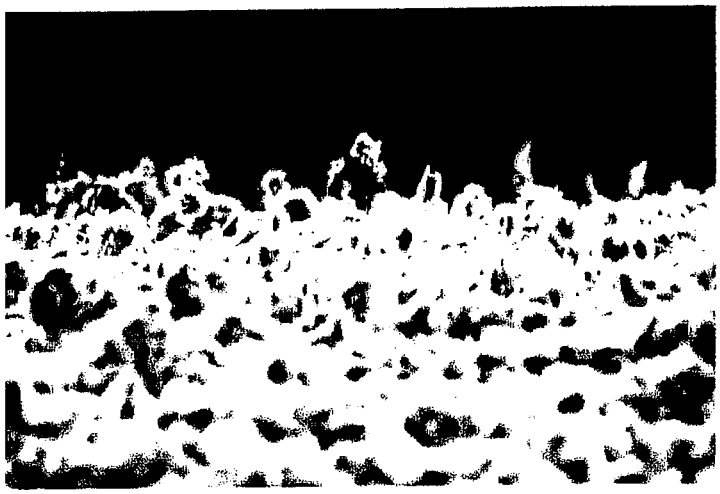
FIG. 10 shows an electron micrograph of a carbon film at an application voltage of 3.0 kV between an anode and a cathode.
Figure 11:
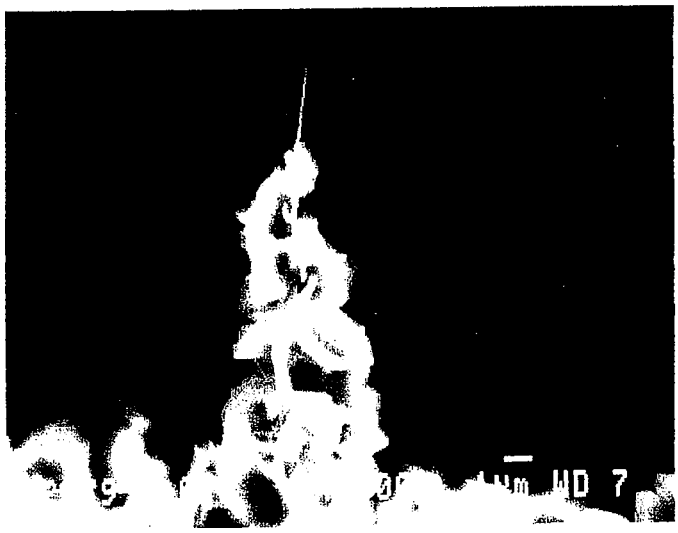
FIG. 11 shows an electron micrograph of a carbon film at an application voltage of 3.0 kV.
Figure 12:
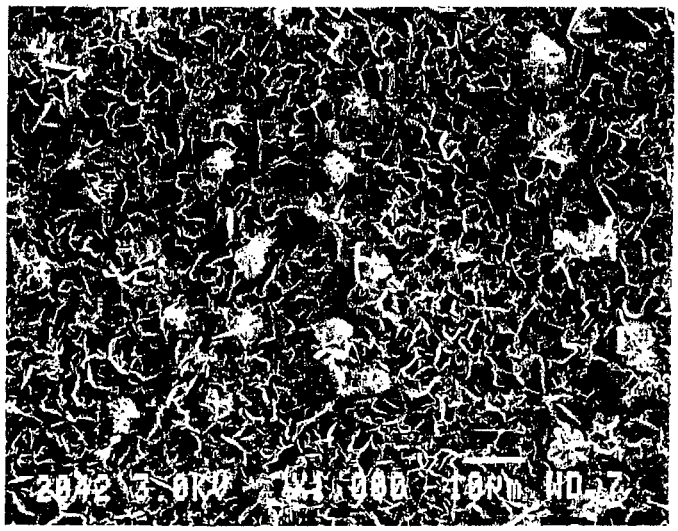
FIG. 12 shows an electron micrograph of a carbon film at an application voltage of 3.0 kV.
Figure 13:
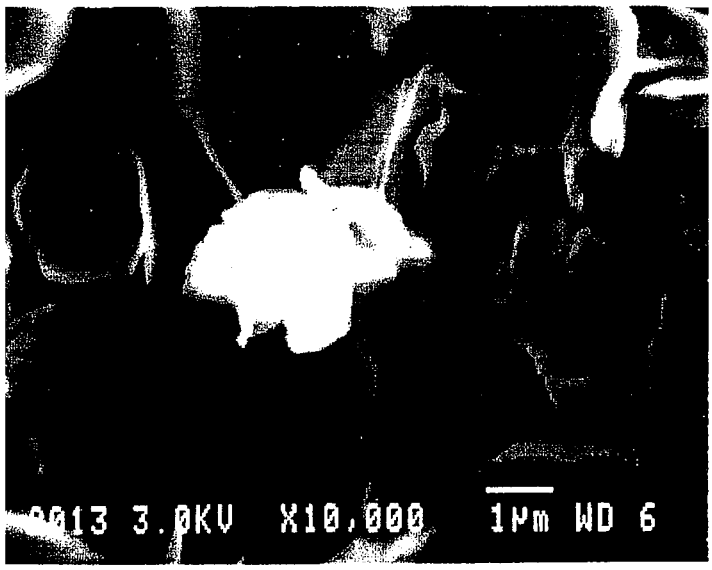
FIG. 13 shows an electron micrograph of a carbon film at an application voltage of 3.0 kV.
Figure 14:
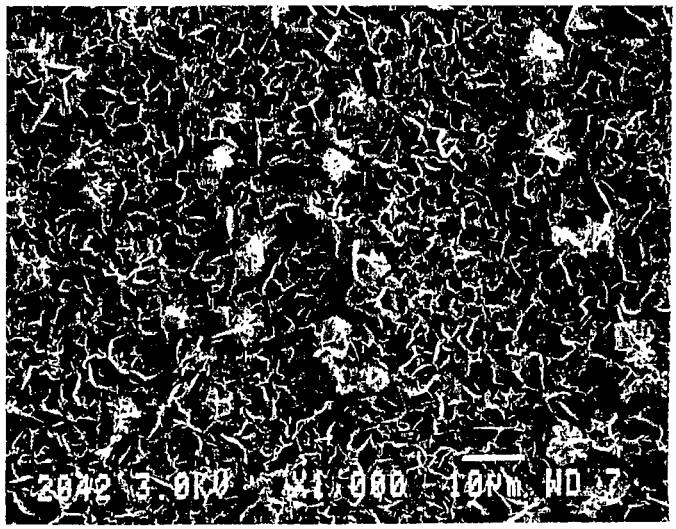
FIG. 14 shows an electron micrograph of a carbon film at an application voltage of 3.0 kV.
Figure 15:
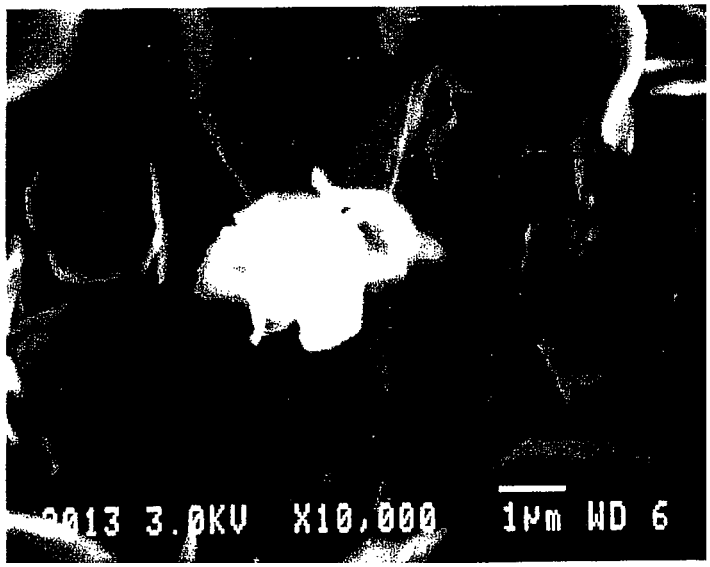
FIG. 15 shows an electron micrograph of a carbon film at an application voltage of 3.0 kV.
Figure 16:
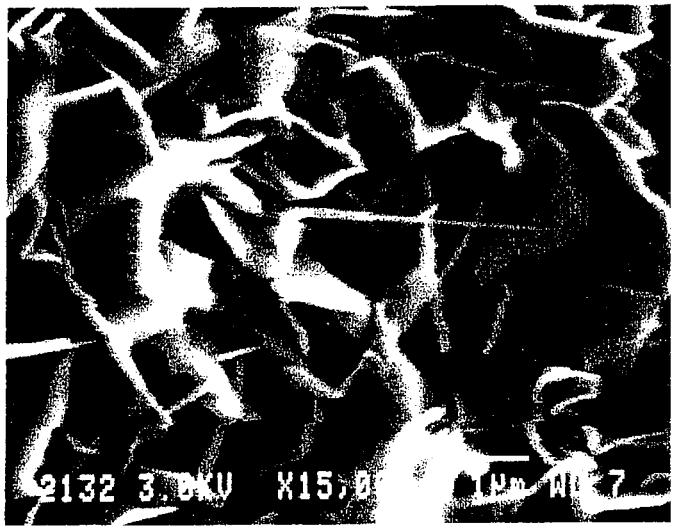
FIG. 16 shows an electron micrograph of a carbon film at an application voltage of 3.0 kV.

FIG. 10 shows an electron micrograph taken when the voltage applied across the anode and the cathode is 3.0 kV and the magnification is 1,000. FIG. 11 shows an electron micrograph taken with the application voltage of 3.0 kV and the magnification of 4,300. FIG. 12 shows an electron micrograph taken with the application voltage of 3.0 kV and the magnification of 1,000. FIGS. 13 and 14 show electron micrographs taken with application voltage of 3.0 kV and the magnification of 10,000. FIG. 15 shows an electron micrograph taken with application voltage of 3.0 kV and the magnification of 10,000. FIG. 16 shows an electron micrograph taken with the application of 3.0 kV and the magnification of 15,000.

FIG. 10 shows a photograph of the carbon film of the embodiment, which is taken from the side (side face direction). The photograph shows a state where a number of mesh carbon films 5 serving as carbon nano walls, and a number of needle-shaped carbon films 3 in the regions surrounded by the mesh carbon films 5.

FIG. 11 is an enlarged photograph of FIG. 10. The photograph shows a state where the needle-shaped carbon film 3 whose tip serves as the electron emission point is formed at a level higher than the level of the mesh carbon film 5 in the region surrounded by the mesh carbon film 5, and the wall-shaped carbon film 7 is formed so as to spread around the film from a lower part to some midpoint in the needle-shaped carbon film 3.

FIG. 12 shows a photograph of the carbon film taken from above. In the photograph, the mesh carbon films 5 connected in a curve shape is formed on the substrate, and the needle-shaped carbon film 3 surrounded by the mesh carbon film 5 is formed.

FIG. 13 is a photograph obtained by magnifying the photograph of FIG. 12 by 10 times.

FIG. 14 is a photograph of the carbon film taken from an oblique direction. The photograph shows a state where the needle-shaped carbon film 3 is formed at a level higher than the mesh carbon film 5 in the region surrounded by the mesh carbon film 5, and the wall-shaped carbon film 7 is formed so as to spread around the needle-shaped carbon film 3 from a lower part to some midpoint in the needle-shaped carbon film 3.

FIG. 15 shows a photograph of the carbon film taken from almost above. The photograph shows a state where the needle-shaped carbon film 3 is formed at a level higher than the mesh carbon film 5 in the region surrounded by the mesh carbon film 5, and the wall-shaped carbon film 7 is formed so as to spread around the needle-shaped carbon film 3 from a lower part to some midpoint of the needle-shaped carbon film 3.

FIG. 16 shows a photograph of the carbon film taken from almost above. The photograph shows a state where the needle-shaped carbon film 3 is formed at a level higher than the mesh carbon film 5 in the region surrounded by the mesh carbon film 5, and the wall-shaped carbon film 7 is formed so as to spread around the needle-shaped carbon film 3 from a lower part to some midpoint in the needle-shaped carbon film 3.

In any of the carbon films shown in the SEM photographs of FIGS. 10 to 16, the needle-shaped carbon film has a shape such that the radius decreases from an arbitrary potion toward the tip.

Figure 17:
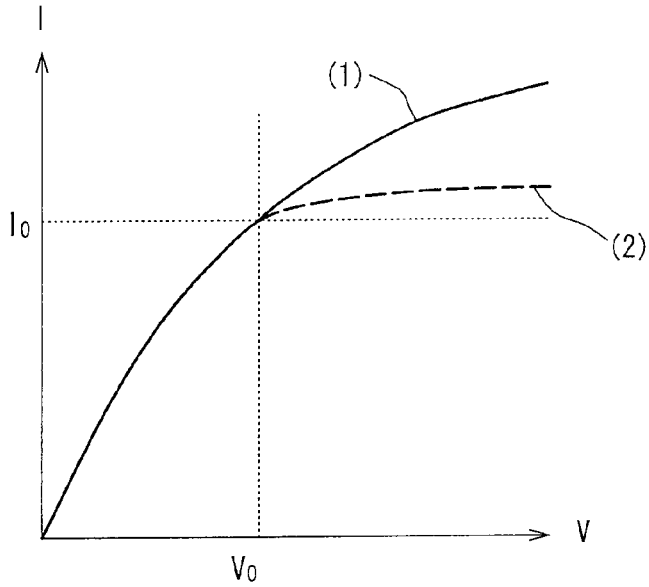
FIG. 17 is a diagram showing a field emission characteristic of an electron emission source having the carbon film structure including the needle-shaped carbon film.

FIG. 17 is a diagram showing a field emission characteristic by the carbon film shown in the SEM photographs of FIGS. 10 to 16. The axis of abscissa of FIG. 17 indicates application voltage, and the axis of ordinate indicates current.

The solid line (1) expresses the field emission characteristic of the carbon film of the first embodiment.

The broken line (2) expresses the field emission characteristic of a carbon nano wall.

As obvious from FIG. 17, the field emission characteristic in the case of the carbon film of the first embodiment is more excellent than that of a carbon nanowall.

Specifically, in the carbon nanotube 1 shown by the broken line (2), after the application voltage V exceeds V0, the field emission from the tip portion 1*a* is saturated and increase in the field emission current I after I0 is suppressed.

In the needle-shaped carbon film 3 of the first embodiment shown by the solid line (1), unlike the carbon nanotube, after the application voltage V exceeds V0, the field effect current I can increase without saturation at the current I0.

Figure 18:
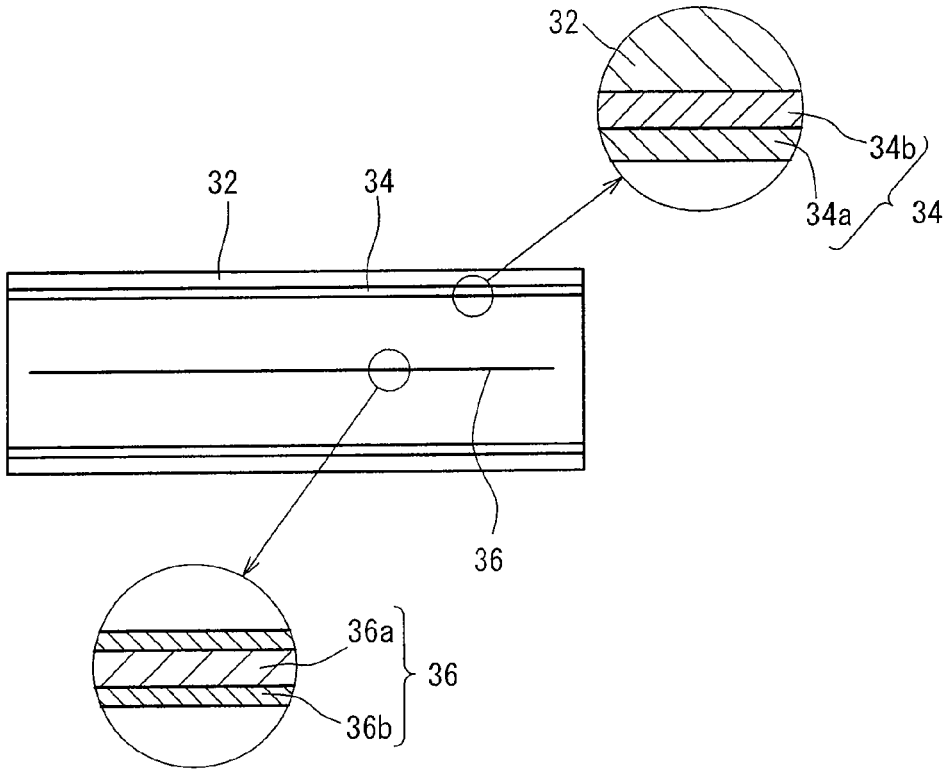
FIG. 18 is a schematic configuration diagram of a field-emission-type illuminating lamp in which an electron emission source using the carbon film structure of the embodiment is assembled.

FIG. 18 shows an example of applying the carbon film of the first embodiment to a pipe-shaped field-emission-type illuminating lamp. In FIG. 18, a tube body 32 in a pipe shape is made of glass, preferably, soda lime glass, and the inside is a vacuum state. The shape of the tube body 32 is not limited to a straight tube shape but may be a U tube shape.

On the inner face of the tube body 32, an anode 34 with phosphor is formed. The anode 34 with phosphor is constructed by a layer-shaped phosphor film 34*a* made of phosphor powders which emit white light by electron beam excitation and a layer-shaped anode film 34*b* formed by depositing a metal having excellent conductivity, preferably, aluminum.

In the center of the tube body 32, a wire cathode 36 is disposed in the longitudinal direction. The wire cathode 36 faces the anode 34 with phosphor in the longitudinal direction.

The wire cathode 36 is formed by a conductive wire 36*a* and a carbon film 36*b* formed on the surface of the conductive wire 36*a*. The material of the wire 36*a* is not limited. Examples of the material are graphite, Ni, Fe, Co, and the like. The carbon film 36*b* is the carbon film shown in FIGS. 1 to 17.

Figure 19A:
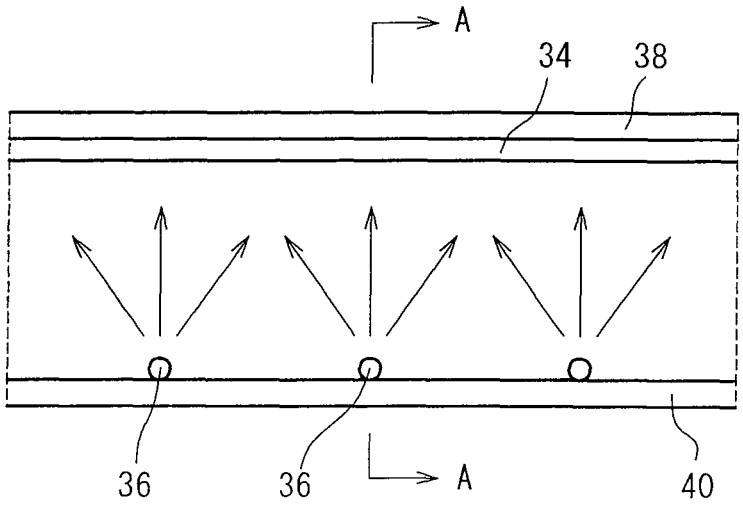
FIG. 19A is a front cross section of the field emission type illuminating lamp in which the electron emission source using the carbon film of the embodiment is assembled.
Figure 19B:
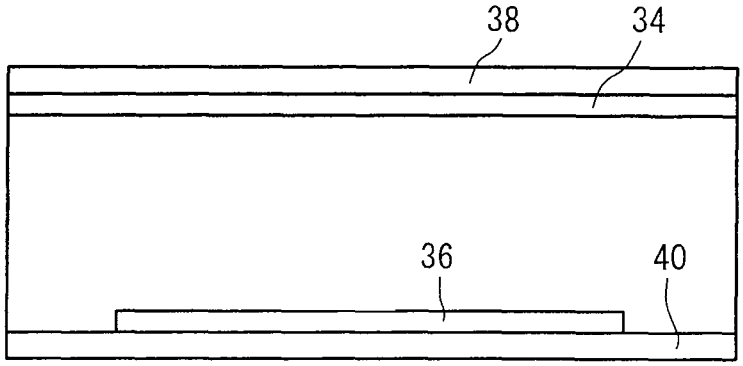
FIG. 19B is a cross section taken along line A-A of FIG. 19A.

FIGS. 19A and 19B show an example of applying the carbon film of a second embodiment to a flat-panel-shaped field-emission-type illuminating lamp. FIG. 19A is a front section view, and FIG. 19B is a cross section taken along line A-A of FIG. 19A.

In those diagrams, the field-emission-type illuminating lamp has flat panels 38 and 40 having therebetween vacuum, an anode 34 with phosphor provided on the inner face of the flat panel 38 as one of the flat panels, and a plurality of wire cathodes 36 disposed at intervals on the other flat panel 40.

Like the illuminating lamp of FIG. 18, the wire cathode 36 includes the conductive wire 36*a* and the carbon film 36*b* formed on the surface of the conductive wire 36*a*. The carbon film 36*b* is the carbon film shown in FIGS. 1 to 17.

ADC voltage was applied across the anode 34 with phosphor and the wire cathode 36 in the illuminating lamp with the configuration and, as a result, light emission with high brightness was obtained.

The result of the test shows that, when the illuminating lamp of the embodiment is used for back light, the resultant is very suitable as back light for illuminating a liquid crystal display panel of a big liquid crystal television or the like with low power consumption and high brightness.

Second Embodiment

Figure 20A:
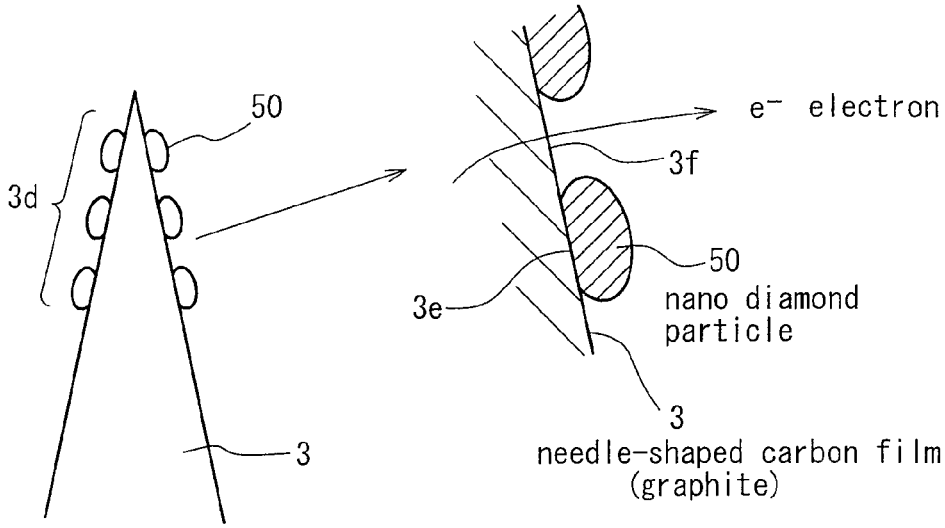
FIG. 20A is a schematic diagram of a tip region portion of a needle-shaped carbon film according to a second preferred embodiment of the invention.
Figure 20B:
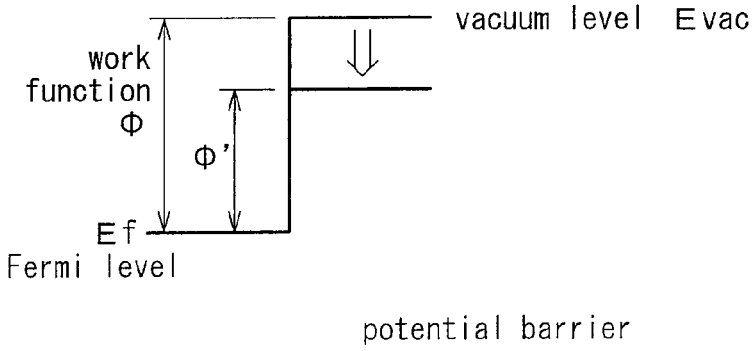
FIG. 20B is a diagram showing an energy level in the tip area of the needle-shaped carbon film of FIG. 20A.

FIGS. 20A and 20B show the needle-shaped carbon film 3 of a second embodiment of the invention. FIG. 20A shows a tip region 3*d* (the tip 3*a* and the peripheries 3*b* and 3*c*) of the needle-shaped carbon film 3. FIG. 20B is a diagram used for explaining a work function. With reference to the diagrams, by mutual action of a surface mirror image between the needle-shaped carbon film 3 and nano diamond particles 50, as shown in FIG. 20B, a vacuum level Vac on the surface of the needle-shaped carbon film 3 drops, a potential barrier $\phi$ (for example, 5.0 eV) of electron emission of the needle-shaped carbon film 3 decreases to $\phi'$ (about 4.2 eV to 4.3 eV). As a result, fields are emitted more easily, and an overall field emission current amount can be increased with low application voltage.

Figure 21A:
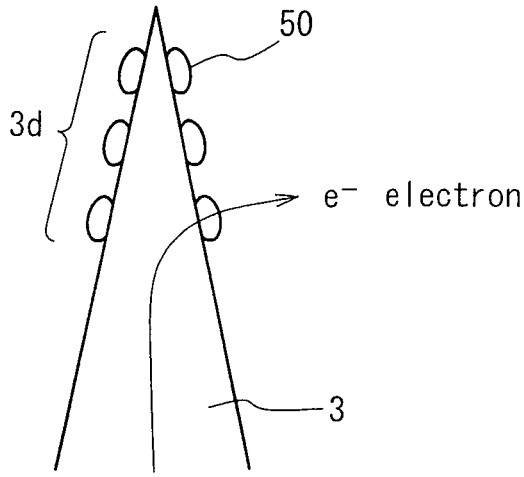
FIG. 21A is a schematic diagram of a tip region part of the needle-shaped carbon film according to the second embodiment.
Figure 21B:
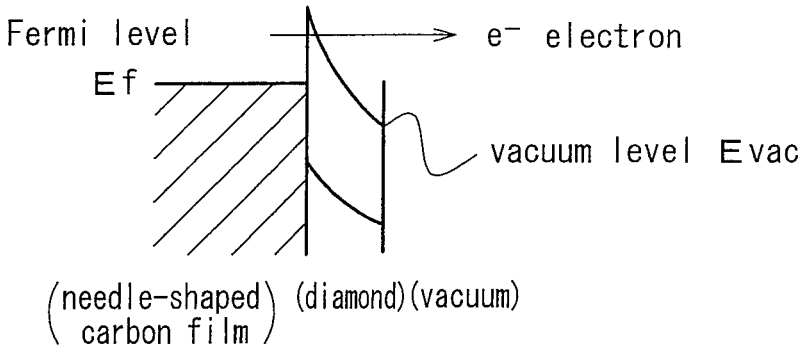
FIG. 21B is a diagram showing an energy level in the tip region of the needle-shaped carbon film of FIG. 21A.

FIGS. 21A and 21B relate to the needle-shaped carbon film 3. FIG. 21A shows the tip region of the needle-shaped carbon film 3, and FIG. 21B is a diagram used for explaining the work function. Since the nano diamond particles 50 are formed in the tip region 3*d* in the needle-shaped carbon film 3, electrons are injected from the needle-shaped carbon film 3 to a conduction level of the nano diamond particles 50. By utilizing negative electron affinity of the surface of the nano diamond particles 50, the potential barrier largely decreases as shown in FIG. 21B. Consequently, by the electron tunneling phenomenon, the field emission is performed efficiently.

In the above, the tip region may be only the tip but is not limited and includes a region around the tip. The size of the nano diamond particle is preferably 10 nm or less.

Preferably, the nano diamond particle is hydrogen terminated. When it is hydrogen-terminated, the nano diamond particle surface is reliably held with negative electron affinity, and the field emission characteristic is stabilized for a long period. Since the needle-shaped carbon film 3 has a structure in which the nano diamond particles are formed in the tip region of the carbon film of the shape having the field concentration coefficient β, the following actions and effects can be displayed.

In other words, in the needle-shaped carbon film 3, the process of forming the nano diamond particles in the tip region of the carbon film can be performed subsequent to the process of forming the carbon film in a needle shape while changing reaction gas, reaction time, and reaction temperature, so that the manufacturing cost can be reduced and manufacture time can be shortened.

In the needle-shaped carbon film 3, by the mutual action of mirror images in an area of a contact interface between the nano diamond particles and the tip region of the carbon film, the vacuum level drops in the area of the contact interface, the fields emit more easily, and the general field emission current amount at low application voltage can be increased.

In the needle-shaped carbon film 3, because of the negative electron affinity of the surface of the nano diamond particles in the tip region, the surface potential barrier of field emission is largely reduced and the field emission is performed efficiently.

Third Embodiment

Figure 22:
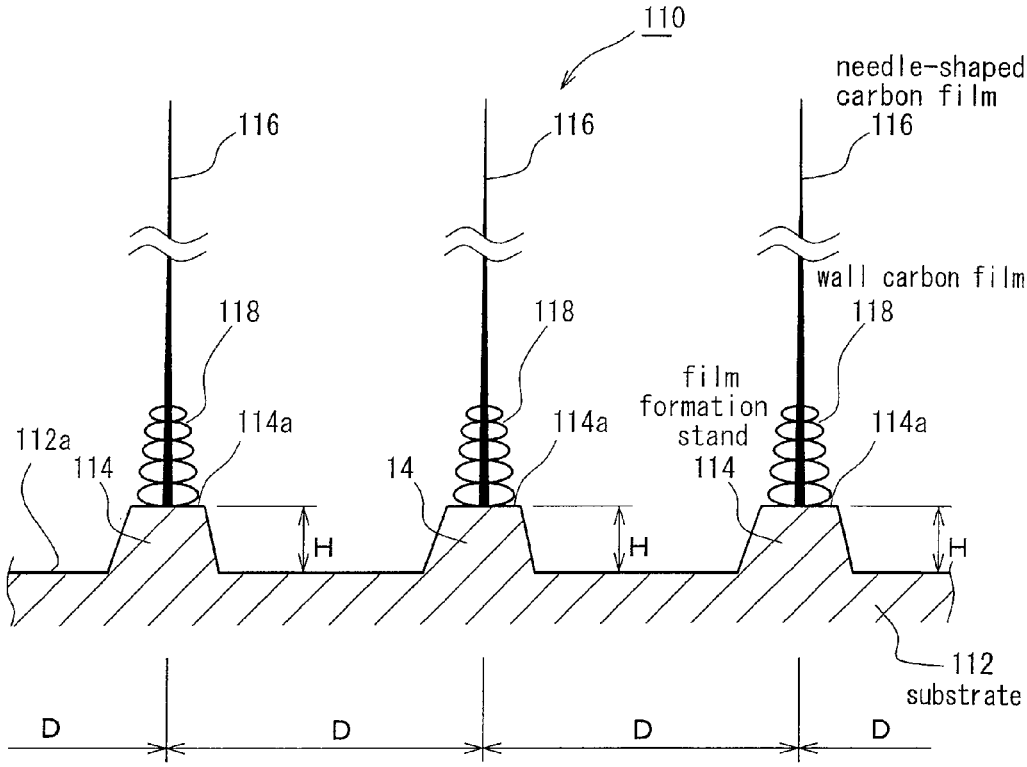
FIG. 22 is a diagram showing the configuration of an electron emitter according to a third preferred embodiment of the invention.

With reference to FIG. 22, a field emission type electron emitter of a third embodiment will be described. An electron emitter 110 has a plurality of film formation stands 114 each having predetermined height on a substrate 112. On the film formation stands 114, needle-shaped carbon films 116 each extending like a needle and wall carbon films 118 extending around the needle-shaped carbon films 116 from the lower part to some midpoint are formed. Although there is a case that the carbon films 116 and 118 are formed on the substrate 112, they are omitted in the drawings.

Preferably, the disposing intervals D between the film formation stands 114 are set so that the field emission at the tip of each of the needle-shaped carbon films 116 on the film formation stands 114 does not inhibit the field emission at the tip of the needle-shaped carbon film 116 on another film formation stand 114.

The height (H) from a substrate face 112*a* of the film formation stand 114 is set equal to or less than height at which the film formation stand 14 does not emit field at a threshold field for the tip of the needle-shaped carbon film 116. The height (H) of the film formation stand 114 can be set as a few μm, for example, 2 to 3 μm. The disposing interval D of the film formation stands 114 is a few μm, for example, 1 to 5 μm.

The film formation stand 114 has a truncated conical shape in side view. The film formation stand 114 is not limited to the shape but may be a circular column shape or a truncated pyramid shape. The film formation stands 114 are formed by using the same material as that of the substrate 112, such as a metal material such as molybdenum, iron, or nickel. In the case where the material of the film formation stand 114 is not the same as that of the substrate 112, the substrate 112 may be made of a material other than the metal material, for example, an insulating material such as glass, silicon, or ceramics.

The wall carbon film 118 contributes to stabilize the posture on the surface 114*a* of the film formation stand 114 of the needle-shaped carbon film 116. Consequently, stabilized field emission can be performed. The wall carbon film 118 is mechanical strongly supported on the surface 114*a* of the film formation stand 114, stability of the electron emitter improves, and the needle-shaped carbon film 116 is enabled to come into excellent electric contact with the surface 114*a* of the film formation stand 114.

Figure 23:
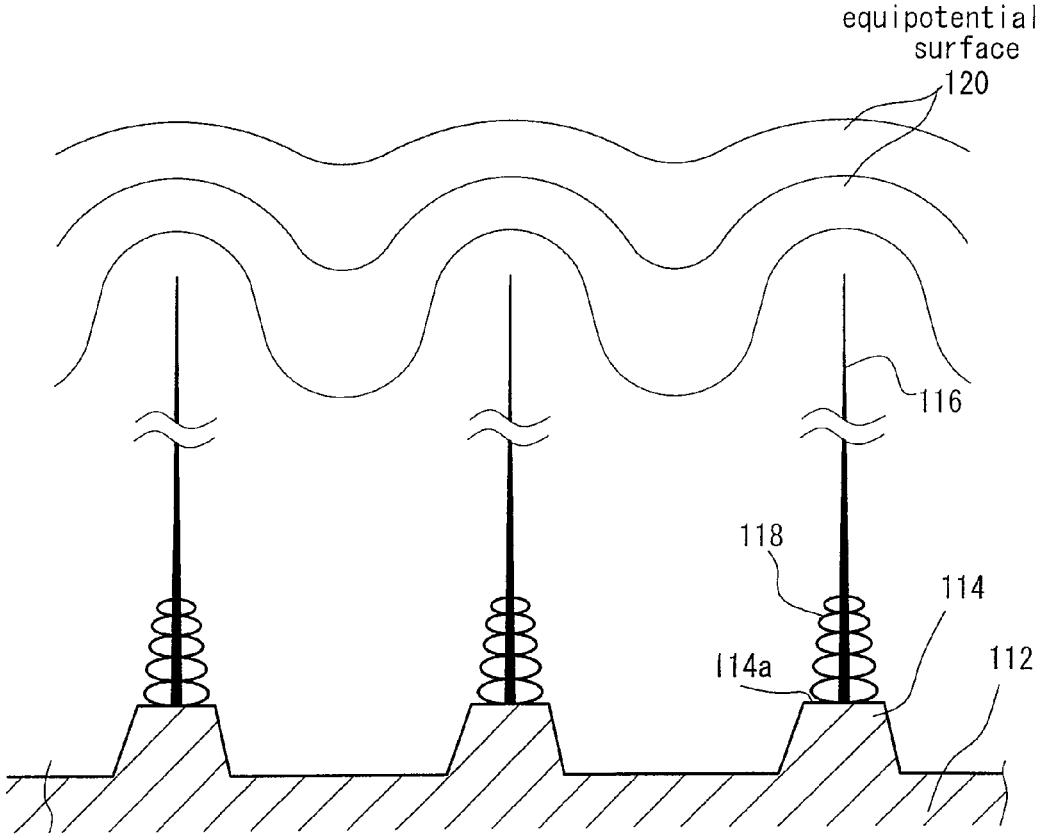
FIG. 23 is a diagram showing an equipotential surface in the electron emitter of FIG. 22.

FIG. 23 shows changes in an equipotential surface 120 around the tips of the needle-shaped carbon film 116 when voltage (anode-cathode voltage V) is applied across the electron emitter 110 as a cathode and an anode positioned upper than the cathode. As shown by the changes in the equipotential surface 120, the electric field is concentrated on the tip of the needle-shaped carbon film 116, and the field can be emitted from the tip.

Figure 24:
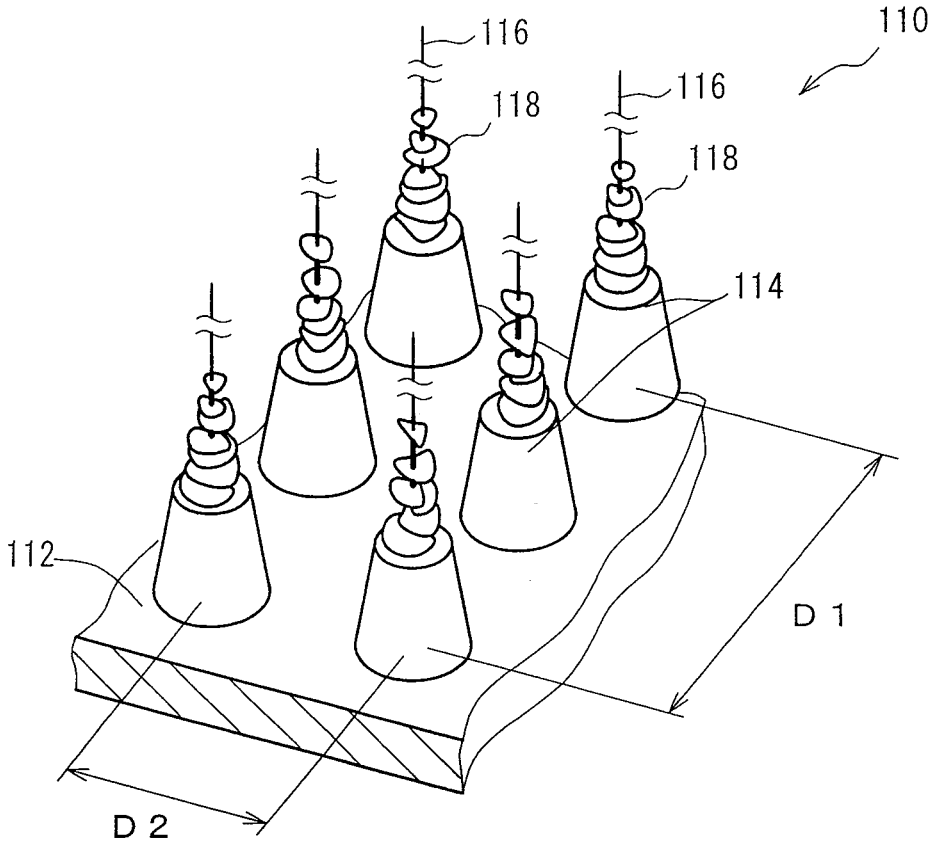
FIG. 24 is a perspective view of a part of the electron emitter of FIG. 22.
Figure 25:
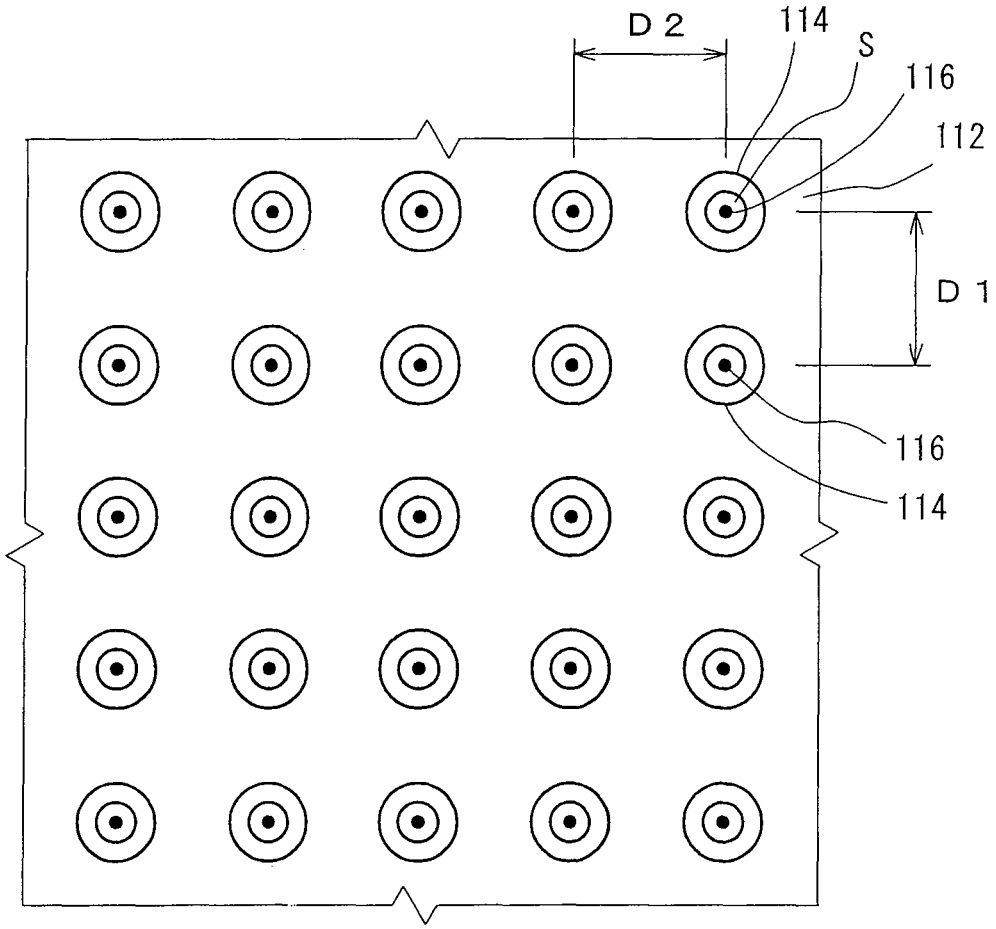
FIG. 25 is a plan view of a part of the electron emitter of FIG. 22.

For understanding of explanation, FIGS. 24 and 25 show a perspective view and a plan view, respectively, of part of the electron emitter. The intervals of disposing the film formation stands 114 are shown by D1 and D2. The intervals may have the relation of D1=D2 or D1≠D2. FIG. 25 shows the area S of the surface 114*a* of the film formation stand 114. By controlling the size of the area S, the number of the needle-shaped carbon films 116 can be controlled.

Figure 26:
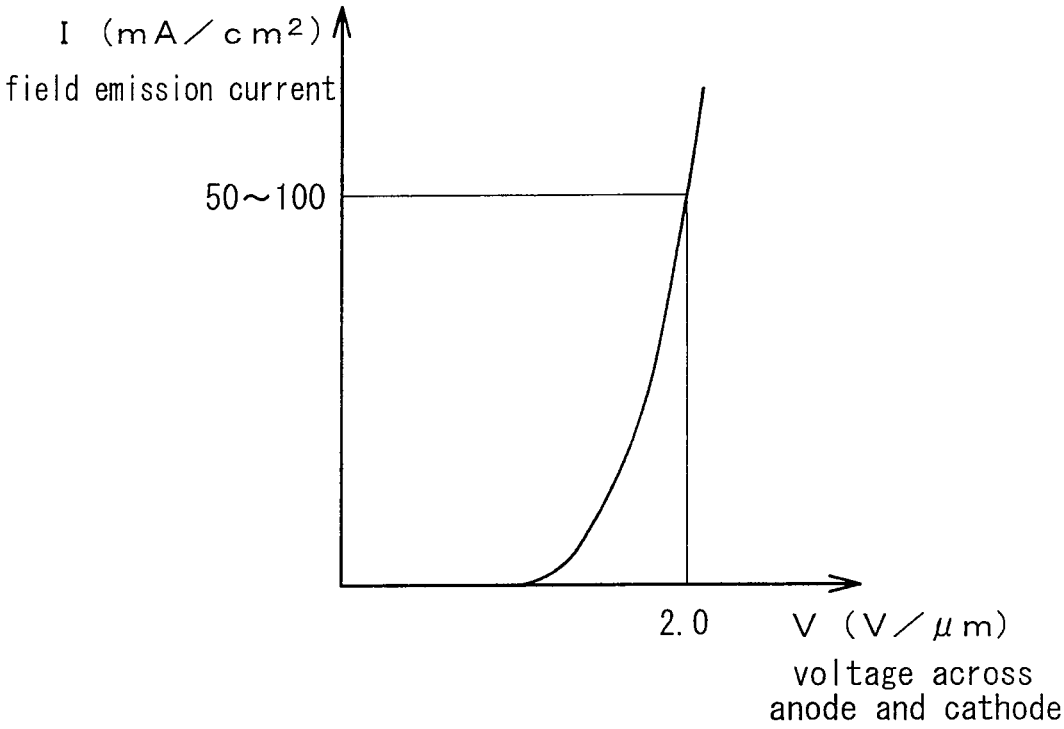
FIG. 26 is a diagram showing emitter characteristics of the electron emitter of FIG. 22.
Figure 27A:
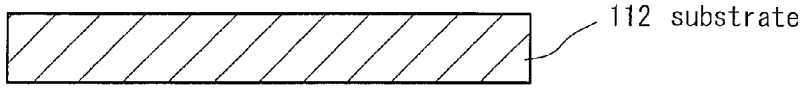
FIGS. 27A to 27F are manufacture process drawings of a film formation stand of the electron emitter.
Figure 27B:
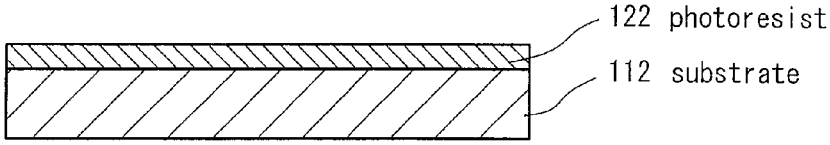
Figure 27C:
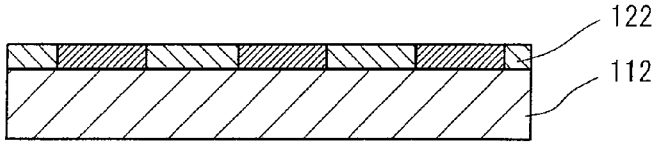
Figure 27D:
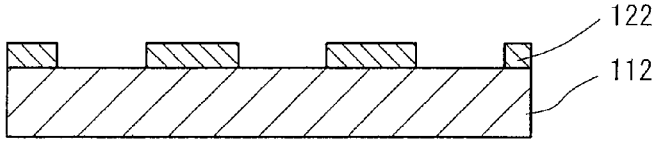
Figure 27E:
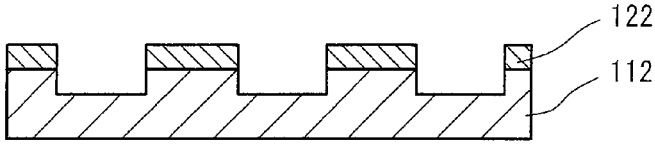
Figure 27F:
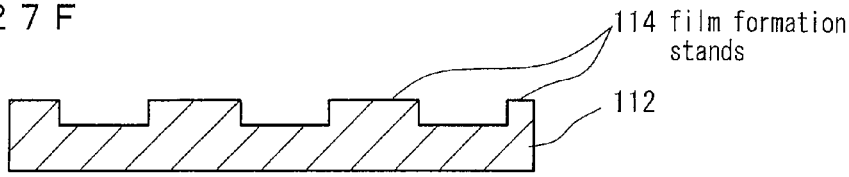

FIG. 26 shows an emission characteristic in the case where the electron emitter 110 having the above-described configuration is used as a cathode and voltage is applied across the electron emitter 110 and an anode disposed so as to face the electron emitter 110. The axis of abscissa shows voltage (V/μm) and the axis of ordinates shows emission current (mA/cm2). As the electron emitter 110 of the third embodiment, as shown in FIG. 30, an electron emitter having a field emission characteristic in which the emission current is 50 to 100 mA/cm2 at the voltage of 2.0 V/μm can be obtained.

Referring now to FIGS. 27A to 27F, processes for manufacturing the film formation stands in the electronic emitter of the embodiment will be described. A photoresist 122 is applied on the substrate 112 shown in process A as shown in process B. After that, as shown in process C, a pattern of a photomask is transferred to the photoresist 122 by exposure. Subsequently, as shown in process D, the photoresist 122 except for the patterns is removed. As shown in process E, etching is performed. Finally, by removing the photoresist 122, the film formation stands 114 integrated with the substrate 112 are formed. After formation of the film formation stands 114 on the substrate 112 by the above-described photolithography technique, the program moves to the process of manufacturing the carbon film.

Figure 28:
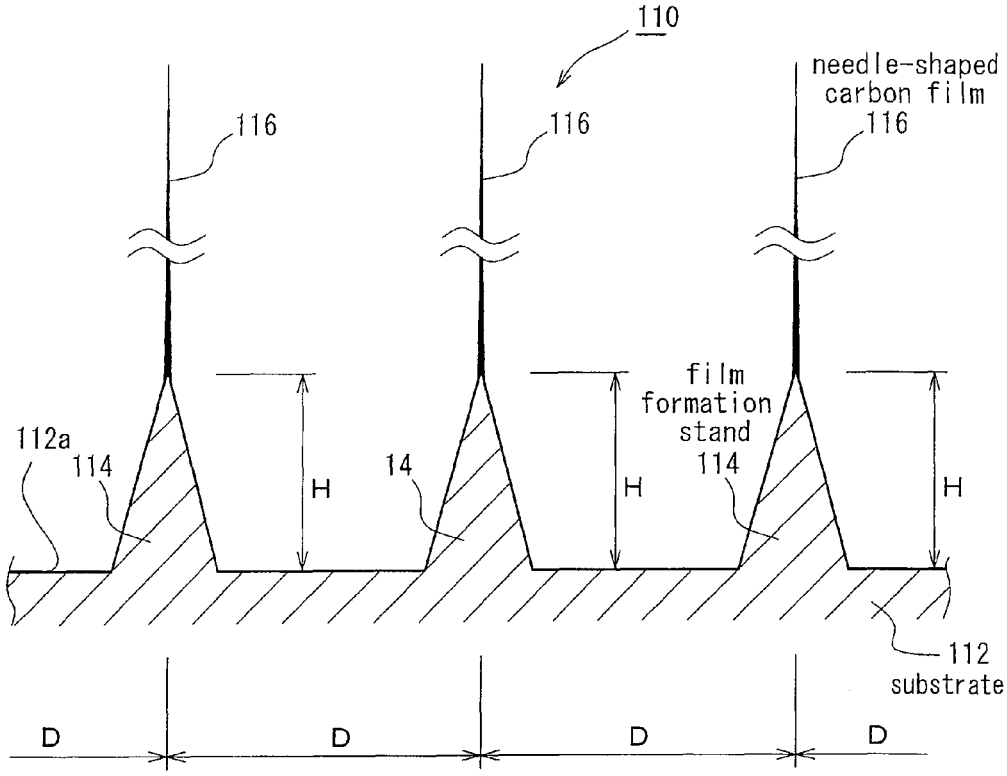
FIG. 28 is a diagram showing a modification of the film formation stand of the electron emitter.

Referring to FIG. 28, the electron emitter 110 has a plurality of film formation stands 114 each having predetermined height on the substrate 112. The surface of the film formation stand 114 has the shape of an apex of a conical shape. The needle-shaped carbon film 116 is formed on the apex of the cone of the film formation stand 114. Since the surface of the film formation stand 114 has the apex of the cone, electric fields tend to concentrate at the time of formation of the needle-shaped carbon film 116, and formation of the needle-shaped carbon film 116 can be promoted.

The electron emitter 110 of third embodiment is quite different from the Spindt type electron emitter required to have a space for ultra high vacuum, and can stably display excellent performances also in an medium high vacuum environment or low vacuum environment in the space of the electron emitter.

The electron emitter 110 of the third embodiment is manufactured in low-cost manufacture facility capable of using a cheap pump such as a diffusion pump for evacuation of the space of the electron emitter and can operate stably with high performance without deterioration in the field emission characteristic.

The electron emitter 110 of the embodiment has the film formation stand having predetermined height on the substrate surface, and the needle-shaped carbon film which becomes narrower toward the tip is formed on the stand. The substrate in this case is not limited to such a shape but may be a plate shape, a wire shape or the like. The sectional shape of a plate or a wire is not limited. For example, the plate shape includes a flat plate shape, and the sectional shape of the wire shape may be circular, semi-circular, oval, semi-oval, or the like.

The "needle shape which becomes narrower toward the tip" does not limit to the shape which continuous becomes narrower from the base to the tip but may be a needle shape which becomes narrower from arbitrary midpoint in the carbon film toward the tip.

The material of the "film formation stand" is not limited to the above but may be a metal material or a semiconductor material.

The "film formation stand" is not limited to the above-described manufacturing methods and structures but can be manufactured from a substrate itself by etching or the like or from a deposited metal thin film having a thickness in μm and provided on the surface of a substrate in a manner similar to the embodiments. Alternatively, the film formation stand can be formed by transferring the stand onto the substrate by using a die for a film formation stand.

In the embodiments, the first feature is that the film formation stand having predetermined height is provided on the substrate face. The second feature is that a needle-shaped carbon film which becomes narrower toward the tip is formed. By combination of the two features, an electron emitter capable of stably displaying excellent performance even in the environments of medium high vacuum or low vacuum, which cannot be realized by a conventional Spindt type can be obtained.

In the electron emitter of the embodiments, the tip for emitting fields is not the metal tip or silicon tip of a conventional Spindt type but is the needle-shaped carbon film formed on the film formation stand. Consequently, the fields can be stably emitted even if a small amount of residual gas molecules or the like is adhered in the environment of not ultra high vacuum of $10^{-8}$ to $10^{-9}$ torr but medium high vacuum or the like. As a result, different from the conventional Spindt type electron emitter, an electron emitter built-in apparatus can be manufactured by evacuating a vacuum chamber in which an electron emitter is housed by a cheap diffusion pump or the like. Since the withstand pressure of the vacuum chamber made of glass or the like having therein an electron emitter may be low, mass production of cheap electron emitter built-in apparatuses can be promoted, and the manufacturing cost can be largely reduced.

Since it is unnecessary to maintain the internal pressure of the vacuum chamber made of glass or the like in which the electron emitter is housed at the ultra high vacuum, stability of the field emission does not sharply deteriorate due to decrease in the internal pressure. Thus, field emission can be stably assured for a long period.

In the electron emitter of the embodiment, particularly, in the case of using the needle-shaped carbon film and the wall carbon film, the needle-shaped carbon film can be connected electrically with high mechanical strength on the film formation stand. As a result, the stable field emission characteristic can be maintained for a long period.

In the electron emitter of the embodiment, particularly, different from the carbon film of a carbon nanotube or the like whose diameter does not change toward the tip, the needle-shaped carbon film having a shape which is narrowed toward the tip is used. Even if the application voltage across the substrate side as the cathode and the anode facing the cathode increases, the field emission is not easily saturated, and the efficient field emission characteristic can be maintained for a long period.

In the electron emitter of the embodiment, the needle-shaped carbon film is disposed on the film formation stand. Consequently, the carbon film formed on another film formation stand and another carbon film formed directly on the substrate surface not on the film formation stand can be easily controlled without inhibiting the field emission.

In the electron emitter of the embodiment, the needle-shaped carbon film is formed on the film formation stand. Consequently, the height from the substrate face to the tip of the needle-shaped carbon film can be arbitrarily adjusted by adjusting the height of the film formation stand.

In the electron emitter of the embodiment, preferably, the height of the film formation stand is set to be equal to or lower than the height at which the film formation stand does not emit field with a threshold field to the tip of the needle-shaped carbon film. The threshold field is a field at which the field emission starts. This setting is preferable since the film formation stand does not emit fields.

In the electron emitter, preferably, a plurality of the film formation stands are disposed at predetermined intervals.

In the electron emitter, preferably, the intervals of disposing the film formation stands are set equal to or larger than a value at which the field emission at the tips of the needle-shaped carbon films on the film formation stands do not inhibit each other.

In the electron emitter, preferably, the side face shape of the film formation stand has an almost trapezoid shape.

In the electron emitter, preferably, the needle-shaped carbon film has a shape in which the field concentration coefficient β in the Fowler-Nordheim equation is expressed by h/r where r denotes the radius in an arbitrary position of the carbon film and h denotes height from the arbitrary portion to the tip.

In the electron emitter, by controlling the number of the film formation stands, the number of electron emission points (light emission sites) can be arbitrarily controlled. By controlling the size of the interval between the film formation stands, the density of the light emission sites can be arbitrarily controlled. By controlling the disposing position of the film formation stand, the light emission site can be set in an arbitrary position. Even when the pressure of the disposing environment is set to medium high vacuum, the electron emitter capable of displaying an excellent field emission characteristic can be manufactured at low cost.

While the preferable embodiments of the present invention are described above in detail, various variation and changes in the arrangement and combination of their components may be made without departing from the spirit and scope of the present invention as recited in the appended claims.

What is claimed is:

1. An electron emitter, comprising:

a film formation stand having predetermined height provided on a substrate surface; and a carbon film formed on the stand, wherein the carbon film is needle-shaped, and wherein the carbon film has a shape whose radius decreases from an arbitrary position toward a tip.

2. The electron emitter according to claim 1, wherein the shape is a shape in which a field concentration coefficient β in the Fowler-Nordheim equation is expressed by h/r where r denotes the radius in an arbitrary position and h denotes height from the arbitrary portion to the tip.

3. The electron emitter according to claim 1, wherein a wall-shaped carbon film is formed from a lower part to some midpoint in the carbon film.

4. The electron emitter according to claim 1, wherein the height of the stand is equal to or less than height at which the stand does not emit field with a threshold field for the tip of the carbon film.

5. The electron emitter according to claim 1, wherein a plurality of stands are disposed at predetermined intervals.

6. The electron emitter according to claim 5, wherein the disposing intervals of the stands are set equal to or larger than a value at which a field emission at a plurality of tips of carbon films on each of the film formation stands do not inhibit each other.

7. The electron emitter according to claim 1, wherein the stand has an almost truncated conical shape, and the carbon film is formed on the surface of the conical stand.

8. The electron emitter according to claim 1, wherein the surface of the stand serves as an apex of a conical shape, and the carbon film is formed on the apex of the cone.

9. The electron emitter according to claim 1, wherein the stand is made from a substrate.

10. The electron emitter according to claim 1, wherein the stand is made from a member different from the substrate.

11. The electron emitter according to claim 1, wherein the stand is formed by etching a substrate.

* * * * *